US008789602B2

(12) United States Patent
Gill et al.

(10) Patent No.: US 8,789,602 B2
(45) Date of Patent: Jul. 29, 2014

(54) BALL DROP MODULE

(75) Inventors: William C. Gill, Katy, TX (US); Michael J. Harris, Houston, TX (US); Aju Abraham, Houston, TX (US); Robert James Costo, Jr., The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 458 days.

(21) Appl. No.: 13/009,587

(22) Filed: Jan. 19, 2011

(65) Prior Publication Data

US 2011/0174505 A1 Jul. 21, 2011

Related U.S. Application Data

(60) Provisional application No. 61/297,022, filed on Jan. 21, 2010.

(51) Int. Cl.
*E21B 34/08* (2006.01)
*E21B 23/04* (2006.01)

(52) U.S. Cl.
USPC ..... 166/318; 166/332.8; 166/386

(58) Field of Classification Search
USPC ..... 166/386, 373, 374, 192, 193, 318, 166/75.15, 177.4, 332.8
See application file for complete search history.

(56) References Cited

U.S. PATENT DOCUMENTS

| | | | | |
|---|---|---|---|---|
| 2,711,220 | A * | 6/1955 | Simmons | 166/147 |
| 4,089,371 | A | 5/1978 | Decuir | |
| 4,474,241 | A * | 10/1984 | Freeman | 166/317 |
| 5,890,538 | A | 4/1999 | Beirute et al. | |
| 5,960,881 | A * | 10/1999 | Allamon et al. | 166/291 |
| 6,920,930 | B2 * | 7/2005 | Allamon et al. | 166/318 |
| 6,959,766 | B2 * | 11/2005 | Connell | 166/373 |
| 7,434,625 | B2 | 10/2008 | Adams | |

* cited by examiner

*Primary Examiner* — Giovanna Wright
(74) *Attorney, Agent, or Firm* — Brandon S. Clark

(57) ABSTRACT

A pressurizing device includes a main housing having a central bore therethrough and a ball drop module removably disposed within the main housing, the ball drop module including a ball seat hingedly attached within the ball drop module and configured to receive a dropped ball, wherein the ball seat is configured to rotate about a hinge from a closed position to an open position when a pressure above the ball seat exceeds a preset limit.

14 Claims, 4 Drawing Sheets

BALL DROP MODULE

CROSS-REFERENCE TO RELATED APPLICATIONS

This application, pursuant to 35 U.S.C. §119(e), claims priority to U.S. Provisional Application Ser. No. 61/297,022, filed Jan. 21, 2010, and which is incorporated herein by reference in its entirety.

BACKGROUND

1. Field of the Disclosure

Embodiments disclosed herein relate generally to downhole tools. In particular, embodiments disclosed herein relate to a pressurizing device having a ball drop module for pressure activating downhole tools.

2. Background Art

In oilfield drilling and completion, various downhole tools in a drillstring may be pressure activated by increasing a pressure in a central bore of the drillstring. To increase the pressure in the central bore, fluid flow through the central bore may be blocked or obstructed at a particular location in the bore, which allows fluid pressure to increase above the obstruction in the bore. Ball drop devices are one such tool that may be used to obstruct the central bore by dropping a steel ball into the central bore and allowing the drilling fluid or similar liquid to carry the ball, assisted by gravity down the hole until the ball lodges in a landing seat located downhole in the bore. The dropped ball may obstruct the fluid flow through the central bore and allow the fluid pressure uphole of the ball to be increased. When activation of a particular tool is complete, the ball may be removed from the central bore, which allows fluid flow to resume through the central bore.

Removal of the ball from the central bore may be carried out in a number of ways. For example, the ball may be made of a drillable material, such that the ball is drilled through to allow the fluid to return to flow through the central bore. Alternatively, the landing seat or ball may be formed of a material such that the ball may be extruded through the seat at a high pressure to remove the ball. However, extrusion or drilling through the ball leaves a reduced diameter section of the central bore at the landing seat location (i.e., the diameter of the central bore is reduced to a diameter of the landing seat orifice). This reduced diameter may prevent additional tools from being passed through to locations downhole of the landing seat.

To reopen the central bore to its original diameter, release mechanisms have been incorporated into the landing seat to allow both the ball and the landing seat to be moved. For example, one such mechanism includes a landing seat having a collet finger mechanism to secure the landing seat in the bore, the collet fingers then being disengaged and the ball and seat forced downhole. However, the collet finger mechanism has proved to be difficult to position and seal properly in the bore, does not provide the ability to reliably activate the downhole tool, and often does not fail predictably when required. Further, the above mentioned mechanisms are not capable of being reused and instead are discarded and lost at a bottom of the wellbore after use.

Accordingly, there exists a need for a reusable ball drop device that may be reliably operated for activation of downhole tools.

SUMMARY OF THE DISCLOSURE

In one aspect, embodiments disclosed herein relate to a pressurizing device including a main housing having a central bore therethrough and a ball drop module removably disposed within the main housing, the ball drop module including a ball seat hingedly attached within the ball drop module and configured to receive a dropped ball, wherein the ball seat is configured to rotate about a hinge from a closed position to an open position when a pressure above the ball seat exceeds a preset limit.

In other aspects, embodiments disclosed herein relate to a method of operating a pressurizing device to activate a downhole tool, the method including circulating a fluid through an orifice in a ball seat of a ball drop module, wherein the ball seat is in a closed position, engaging a dropped ball with the orifice of the ball seat and obstructing fluid flow through the orifice, increasing a fluid pressure uphole of the ball seat to an activation pressure of the downhole tool, and increasing the fluid pressure uphole of the ball seat above a preset pressure limit to shear one or more shear pins and open the ball seat.

Other aspects and advantages of the invention will be apparent from the following description and the appended claims.

DETAILED DESCRIPTION

In one aspect, embodiments disclosed herein relate to a reusable pressurizing device having a ball drop module for pressure activating downhole tools and methods of using the ball drop module.

Figure 1:
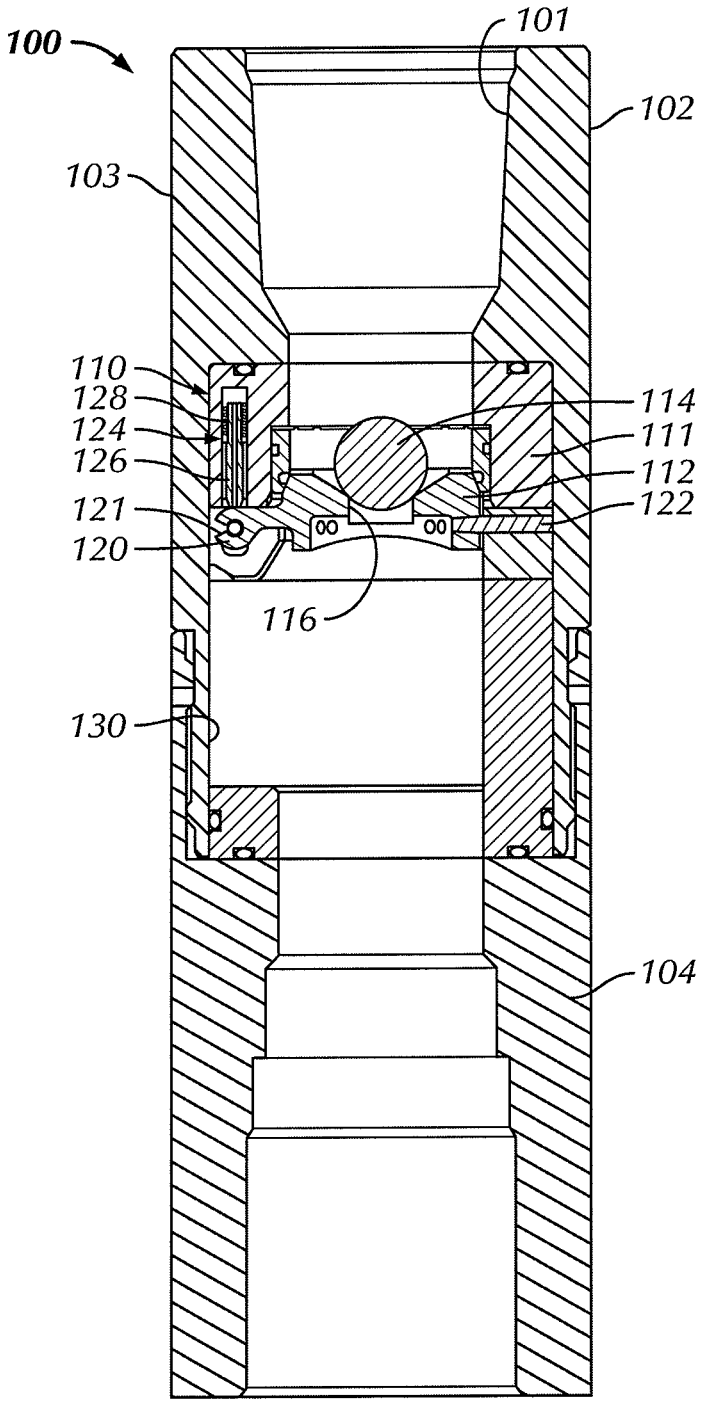
FIG. 1 is a cross-sectional view of a pressurizing device having a ball drop module in a closed position in accordance with embodiments of the present disclosure.

Referring to FIG. 1, a cross-sectional view of the pressurizing device 100 is shown in accordance with embodiments of the present disclosure. Pressurizing device 100 includes a main housing 103 having a central bore 101 therethrough that is comprised of a first housing 102 and a second housing 104, which may be coupled together. A ball drop module 110 is disposed within the main housing and held in place between first housing 102 and second housing 104. Thus, ball drop module 110 may be characterized as a "cartridge-type" system that is easily installed and removed from the main housing. Pressurizing device 100 may include one or more seals disposed between first and second housings 102, 104 and ball drop module 110 to prevent fluid leakage between the main housing and ball drop module 110. Although two separate housings 102 and 104 coupled together are shown, those skilled in the art will understand that, alternatively, a single integral main housing having ball drop module 110 disposed therein may be used.

Figure 2:
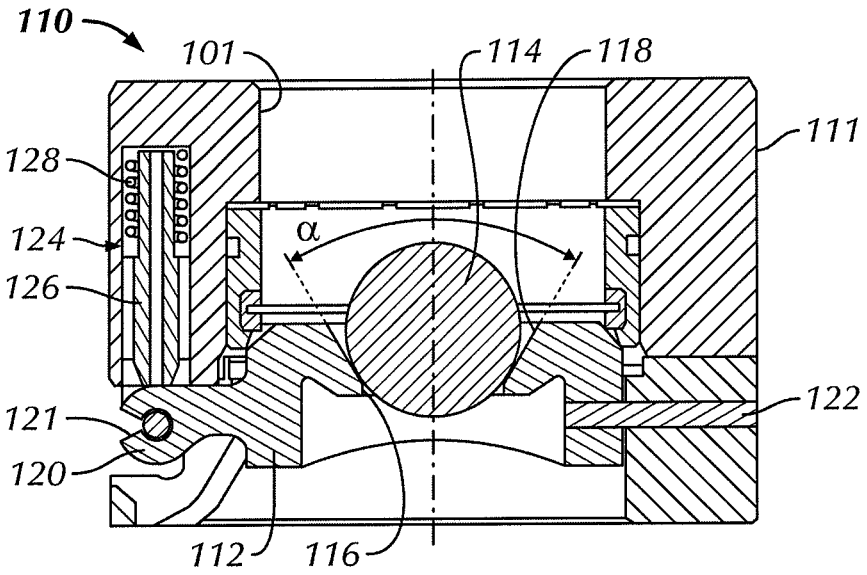
FIG. 2 is a detailed cross-sectional view of the ball drop module in a closed position in accordance with embodiments of the present disclosure.

Referring to FIGS. 1 and 2, ball drop module 110 includes a cylindrical body 111 in which a ball seat 112 having a centrally located orifice 116 is located. Ball seat 112 further includes a hinge 120 attached to housing 111 about which ball seat 112 is configured to rotate. As shown, a ball 114 is configured to engage ball seat 112. As shown, ball seat 112 is initially secured in a position perpendicular to central bore 101 by one or more shear pins 122, which are inserted radially through an outer wall of cylindrical body 111 and into ball seat 112. Further, ball drop module 110 includes a locking mechanism 124, which comprises a lock pin 126 and a biasing mechanism 128 (e.g., a spring) disposed within a cavity of cylindrical body 111. Lock pin 126 is configured to move in an axial direction and engage a notch 121 of hinge 120 when ball seat 112 rotates about hinge 120 to an open position, or parallel to central bore 101, as will be described later.

Ball seat 112 is configured to allow dropped ball 114 to sealingly engage orifice 116 when seated, and thus prevent fluid flow therethrough. Ball seat 112 is configured having an angled inlet surface 118 with which ball 114 contacts. Angled inlet surface 118 may be configured such that when ball seat 112 is in the closed position the angled inlet surface 118 is steep enough to centrally position ball 114 in orifice 116, and when ball seat 112 is in the open position the angled inlet surface 118 is shallow enough to allow ball 114 to fall out of and away from orifice 116. To allow for such movement, angle a of angled inlet surface 118 may vary within a range of about 90 degrees to about 150 degrees.

Methods of using ball drop module 110 include initially orienting ball seat 112 in a closed position (i.e., perpendicular to central bore 101) and inserting one or more shear pins 122 to secure ball seat 112, as shown in FIGS. 1 and 2. The number, shape, and material of the shear pins 122 used to secure ball seat 112 determine a preset pressure limit at which shear pins 122 will fail and allow ball seat 112 to open. Thus, the pressure limit, which may be between about 1500 and 5000 psi, may be preset by securing ball seat 112 with a certain number or kind of shear pins 122. In certain embodiments, each shear pin may withstand up to about 500 psi. So for example, three shear pins may be inserted to set the pressure limit at 1500 psi and 10 shear pins may be inserted to set the pressure limit at 5000 psi. However, in general, those skilled in the art will understand calculating the number of shear pins required to attain failure at the preset pressure limit.

After ball seat 112 is secured in the closed position, ball drop module 110 may then be installed within main housing 103 and subsequently run downhole into a wellbore. Ball drop module 110 may be secured within main housing 103 with threads or other known fastener mechanisms. Otherwise, ball drop module 110 may be secured merely by being restricted between first housing 102 and second housing 104 of main housing 103. Before ball 114 is dropped, fluid may flow through unobstructed orifice 116 of ball seat 112. Ball 114 may then be dropped or inserted into the fluid and allowed to travel downward through central bore 101 until it contacts angled inlet surface 118 of ball seat 112. Contact between ball 114 and inlet surface 118 may provide a complete obstruction in central bore 101 that prevents fluid from continuing past ball seat 112. After ball 114 engages ball seat 112, fluid pressure above ball seat 112 may be increased to activate certain downhole tools (not shown).

Figure 3:
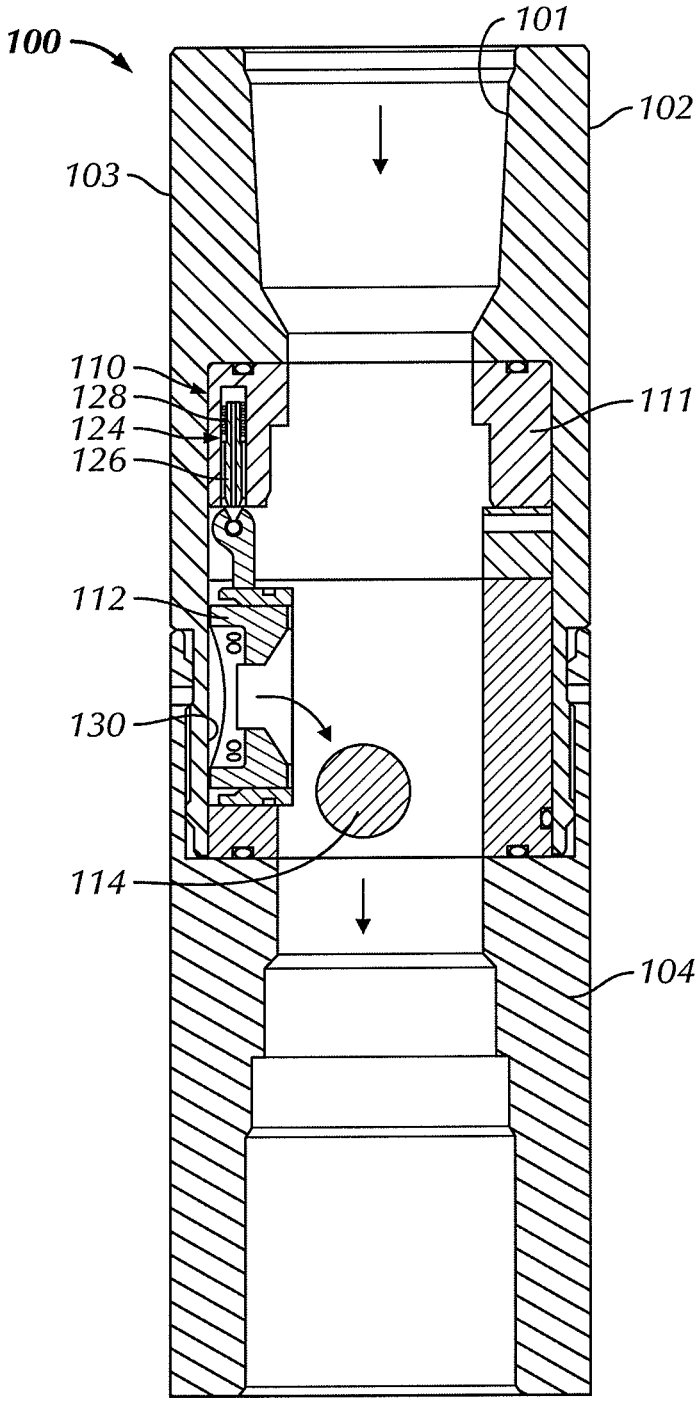
FIG. 3 is a cross-sectional view of the pressurizing device having the ball drop module in an open position in accordance with embodiments of the present disclosure.
Figure 4:
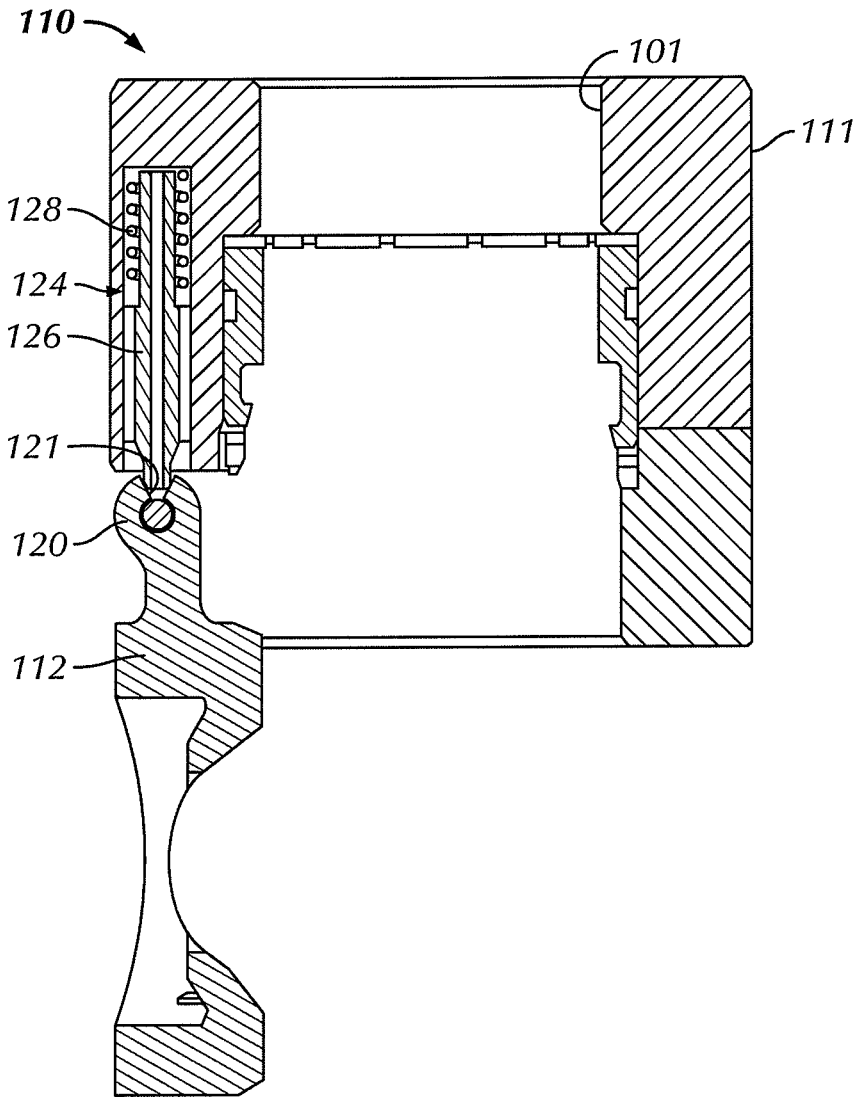
FIG. 4 is a detailed cross-sectional view of the ball drop module in an open position in accordance with embodiments of the present disclosure.

Referring now to FIGS. 3 and 4, cross-sectional views of ball drop module 110 in an open position are shown in accordance with embodiments of the present disclosure. After activation of downhole tools is complete, ball 114 may be removed from ball seat 112 to allow fluid or additional tools to pass through central bore 101 unobstructed. To remove the ball 114, fluid pressure above the obstructed ball seat 114 may be further increased to exceed the preset pressure limit (previously described) and cause the one or more shear pins 122 to fail. After the one or more shear pins 122 fail, ball seat 112 may rotate about hinge 120 from the closed position to the open position. Ball 114 may roll out of contact with angled inlet surface 118 of orifice 116 and continue downhole, where it is lost. Ball seat 112 may continue to rotate about 90 degrees until reaching the open position, at which point ball seat 112 is stored within a pocket or cavity 130 formed in a wall of cylindrical body 111 of ball drop module 110.

Locking mechanism 124 is configured to secure ball seat 112 in the open position and ensure that ball seat 112 remains positioned flush with the inner surface of main housing 103 and/or the inner surface of ball drop module 110. Locking mechanism 124 secures ball seat 112 with lock pin 126, which is forced by biasing mechanism (spring) 128 into engagement with notch 121 on hinge 120. With ball seat 112 in the open position, fluid and any additional tools may be run downhole through central bore without obstruction. Subsequently, pressurizing device 100 may be returned to the surface and ball drop module 110 may be quickly removed and reset with new shear pins 122 for continued use.

Advantageously, embodiments of the present disclosure provide a reusable ball drop module for used with a pressurizing device in oil and gas casing. The entire ball drop module (except for disposable dropped ball and shear pins) may be reused for pressurization multiple times with little expense or labor required. The ball drop module is simply brought to the surface, reset to the closed position with new shear pins, and run back downhole. Further, the "drop-in" installation of the cartridge-type ball drop module into the pressurizing device makes accessibility very easy, and thus, any required maintenance may require minimal time and labor.

Still further, the ball drop module may provide a reliable ball seat with which the dropped ball may engage and seal. The ball drop module is easily oriented within the main housing of the pressurizing device, thus reducing chances of undesirable failures and leaks during high pressure activation of downhole tools. In addition, the ball drop module is easily configurable for various applications requiring different downhole pressures, as the ball drop module may be configured for use at various preset pressure limits by selecting a particular number or types of shear pins. The ball drop module may also be configured to be used with a number of different liner and/or casing sizes.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A pressurizing device comprising:

a main housing having a central bore therethrough;

a ball drop module removably disposed within the main housing, the ball drop module comprising:

a ball seat having an orifice, the ball seat being hingedly attached within the ball drop module and configured to receive a dropped ball in the orifice when the ball seat is oriented in a closed position;

wherein the ball seat is configured to rotate about a hinge from a closed position to an open position when a pressure above the ball seat exceeds a preset limit, wherein in the open position the ball seat sits flush within a cavity formed in a cylindrical body of the ball drop module.

2. The pressurizing device of claim 1, wherein in the closed position the ball seat is positioned perpendicular to the central bore of the main housing.

3. The pressurizing device of claim 1, wherein in the open position the ball seat is positioned parallel to the central bore of the main housing.

4. The pressurizing device of claim 1, wherein the ball seat comprises an angled inlet surface proximate the orifice configured to seat the dropped ball in a center of the orifice.

5. The pressurizing device of claim 4, wherein the angled inlet surface is configured at an angle of between about 90 and 150 degrees.

6. The pressurizing device of claim 1, wherein the main housing comprises a first housing coupled with a second housing.

7. The pressurizing device of claim 1, further comprising at least one shear pin configured to be inserted radially through the ball drop module to engage the ball seat in the closed position.

8. The pressurizing device of claim 7, wherein the at least one shear pin is configured to fail at a fluid pressure of about 500 psi.

9. A pressurizing device comprising:

a main housing having a central bore therethrough;

a ball drop module removably disposed within the main housing, the ball drop module comprising:

a ball seat having an orifice, the ball seat being hingedly attached within the ball drop module and configured to receive a dropped ball in the orifice when the ball seat is oriented in a closed position; wherein the ball seat is configured to rotate about a hinge from a closed position to an open position when a pressure above the ball seat exceeds a preset limit; and a locking mechanism to secure the ball seat in the open position, wherein the locking mechanism comprises a spring-biased lock pin configured to engage a notch formed in the hinge of the ball seat when the ball seat is in the open position.

10. A method of operating a pressurizing device to activate a downhole tool, the method comprising:

circulating a fluid through an orifice in a ball seat of a ball drop module, wherein the ball seat is in a closed position;

engaging a dropped ball with the orifice of the ball seat and obstructing fluid flow through the orifice;

increasing a fluid pressure uphole of the ball seat to an activation pressure of the downhole tool;

increasing the fluid pressure uphole of the ball seat above a preset pressure limit to shear one or more shear pins and open the ball seat by pivoting the ball seat about a hinge; and locking the ball seat in the open position, wherein the locking comprises engaging a spring-biased lock pin with a notch formed in a hinge of the ball seat.

11. The method of claim 10, further comprising setting the preset pressure limit by selecting a certain number of shear pins to secure the ball seat in the closed position.

12. The method of claim 10, wherein the preset pressure limit is within a range of about 1500 to 5000 psi.

13. The method of claim 10, further comprising removably disposing the ball drop module within a main housing.

14. The method of claim 10, further comprising resetting the ball seat in a closed position.

* * * * *